US007015883B2

(12) United States Patent
Okuda

(10) Patent No.: US 7,015,883 B2
(45) Date of Patent: Mar. 21, 2006

(54) LIGHT EMISSION DISPLAY DRIVE METHOD AND DRIVE APPARATUS USING A MODULATOR CAPABLE OF PERFORMING CONTROL AT THREE OR MORE LEVELS IN AN OUTPUT BRIGHTNESS VALUE

(75) Inventor: Yoshiyuki Okuda, Saitama (JP)

(73) Assignee: Pioneer Corporation, Tokyo (JP)

( * ) Notice: Subject to any disclaimer, the term of this patent is extended or adjusted under 35 U.S.C. 154(b) by 467 days.

(21) Appl. No.: 10/090,639

(22) Filed: Mar. 6, 2002

(65) Prior Publication Data

US 2002/0130893 A1 Sep. 19, 2002

(30) Foreign Application Priority Data

Mar. 7, 2001 (JP) ..... P2001-063732

(51) Int. Cl.
*G09G 3/30* (2006.01)

(52) U.S. Cl. ..... 345/77; 345/692

(58) Field of Classification Search ..... 345/82, 345/76, 691, 74.1, 75.2, 87, 531, 690, 692, 345/694, 83, 77; 315/169.1, 169.3
See application file for complete search history.

(56) References Cited

U.S. PATENT DOCUMENTS

| | | | | |
|---|---|---|---|---|
| 6,144,164 | A * | 11/2000 | Ito | 315/169.3 |
| 6,424,349 | B1 * | 7/2002 | Kim | 345/531 |
| 6,597,371 | B1 * | 7/2003 | Mandl | 345/691 |
| 6,803,891 | B1 * | 10/2004 | Okuda | 345/82 |
| 2005/0024304 | A1 * | 2/2005 | Okuda | 345/82 |

* cited by examiner

*Primary Examiner*—Chanh Nguyen
(74) *Attorney, Agent, or Firm*—Sughrue Mion, PLLC

(57) ABSTRACT

In a light emission display drive method, a driver capable of performing control of three or more levels in the output brightness of each light emission element is provided and when the intermediate level is represented, a ΔΣ modulator controls the distribution of the occurrence probability of each level, whereby multi-level gradation representation is conducted. At this time, one channel of ΔΣ modulator is provided and a quantizer with "N-1"-value threshold, N-value output is used and the driver is controlled in response to output of the quantizer or separate ΔΣ modulators are provided for weight multiple outputs and the input values to represent gradation are distributed through a distributor.

4 Claims, 6 Drawing Sheets

FIG. 3A

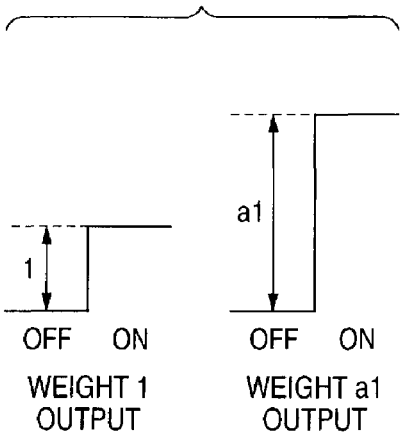

FIG. 3B

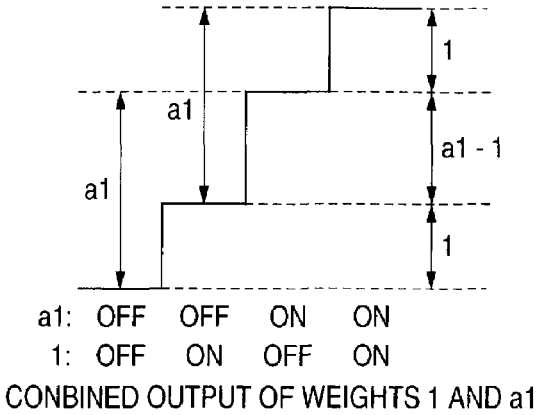

FIG. 4

| | |
|---|---|
| WEIGHT RATIO OF TWO OUTPUTS | 1 : a1 WHERE a1 > 1 |
| INPUT RANGE: x1 TO x2<br>(AS CONVERSION OF EIGHT BITS: 0 TO 255) | -127.5 TO +127.5<br>(CENTER IS 0.0 AND WIDTH IS 255) |
| FOUR VALUES OF QUANTIZER OUTPUT<br>y1, y2, y3, y4 | AS PEAK-TO-PEAK VALUE<br>[ y1, y4 ] = [ x1 - α, x2 + α ]<br>SET A LITTLE WIDER THAN INPUT<br><br>AS INTERMEDIATE VALUES y2 AND y3 ARE SET SO THAT<br>(y4 - y1) : (y3 - y1) : (y2 - y1)<br>= (a1 + 1) : a1 : 1 |
| THREE LEVELS OF QUANTIZER THRESHOLD<br>z1, z2, z3 | z1 = (y1 + y2) / 2<br>z2 = (y2 + y3) / 2<br>z3 = (y3 + y4) / 2<br>SET TO MIDDLE POINT OF LEVEL DIFFERENCE |

WHEN a1 = 2

| | |
|---|---|
| b1 : b2: b3 | 1 : 1 : 1 |
| x1, x2 | -127.5, +127.5 |
| y1, y2, y3, y4 | IF THE PEAK-TO-PEAK VALUE IS,<br>FOR EXAMPLE,<br>[ y1, y4 ] = [ -130.5, +130.5 ]<br>OTHERS ARE DETERMINED<br>[ y2, y3 ] = [ -43.5, +43.5 ]<br>IN CONCLUSION,<br>[ y1, y2, y3, y4 ] = [ -130.5, -43.5, +43.5, +130.5 ] |
| z1, z2, z3 | -87.0, 0.0, +87.0 |

WHEN a1 = 4

| | |
|---|---|
| b1 : b2: b3 | 1 : 3 : 1 |
| x1, x2 | -127.5, +127.5 |
| y1, y2, y3, y4 | IF THE PEAK-TO-PEAK VALUE IS,<br>FOR EXAMPLE,<br>[ y1, y4 ] = [ -132.5, +132.5 ]<br>OTHERS ARE DETERMINED<br>[ y2, y3 ] = [ -79.5, +79.5 ]<br>IN CONCLUSION,<br>[ y1, y2, y3, y4 ] = [ -132.5, -79.5, +79.5, +132.5 ] |
| z1, z2, z3 | -106.0, 0.0, +106.0 |

FIG. 8A

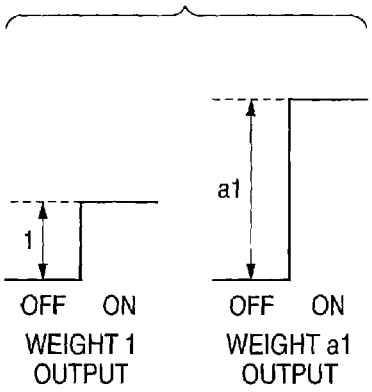

FIG. 8B

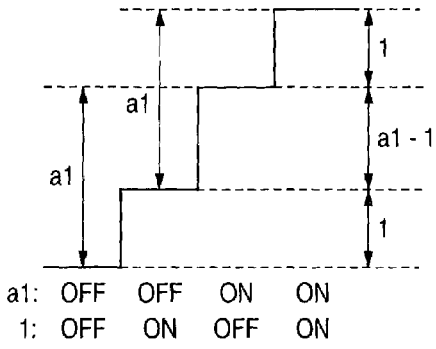

FIG. 9

| | |
|---|---|
| WEIGHT RATIO OF TWO OUTPUTS | 1 : a1 WHERE a1 > 1 |
| INPUT RANGE: x1 TO x2<br>(AS CONVERSION OF EIGHT BITS: 0 TO 255) | -127.5 TO +127.5<br>(CENTER IS 0.0 AND WIDTH IS 255) |
| FOUR VALUES OF QUANTIZER OUTPUT IN METHOD 1<br>y1, y2, y3, y4<br>(AS REFERENCE VALUES TO SET p1, p2, q1 AND q2) | AS PEAK-TO-PEAK VALUE<br>[ y1, y4 ] = [ x1 - $\alpha$, x2 + $\alpha$ ]<br><br>AS INTERMEDIATE VALUES y2 AND y3 ARE SET SO THAT<br>(y4 - y1) : (y3 - y1) : (y2 - y1)<br>= (a1 + 1) : a1 : 1 |
| TWO VALUES OF WEIGHT 1 QUANTIZER OUTPUT<br>p1, p2<br>THRESHOLD LEVEL pz1 | p1 = - (y2 - y1) / 2<br>p2 = + (y2 - y1) / 2<br>pz1 = 0.0<br>CENTER VALUE OF p1 AND p2 |
| TWO VALUES OF WEIGHT a1 QUANTIZER OUTPUT<br>q1, q2<br>THRESHOLD LEVEL qz1 | q1 = - (y3 - y1) / 2<br>q2 = + (y3 - y1) / 2<br>qz1 = 0.0<br>CENTER VALUE OF q1 AND q2 |

LIGHT EMISSION DISPLAY DRIVE METHOD AND DRIVE APPARATUS USING A MODULATOR CAPABLE OF PERFORMING CONTROL AT THREE OR MORE LEVELS IN AN OUTPUT BRIGHTNESS VALUE

BACKGROUND OF THE INVENTION

1. Field of the Invention

This invention relates to a light emission display drive method and drive apparatus preferred for use for multiple-level gradation display of a flat panel of organic EL, light emitting diode, plasma, etc.

2. Description of the Related Art

To change the light emission amount of each dot in the above-mentioned light emission display, the amount of charges injected within the drive time period of the target element may be changed and thus a method of changing the current value or a method of changing the on time with the current value fixed can be used.

For convenience, the former is called analog method and the latter is called pulse modulation or time division method. In the analog method, high-accuracy linearity is required to change the drive current in response to the brightness value; particularly, with TFT, the linearity and stability of the gate voltage vs drain current characteristic are poor and it is difficult to provide good performance.

On the other hand, in the pulse modulation method, a constant current needs only to be output and thus the drive section is miniaturized and the temperature characteristic is also good. In the pulse modulation, a $2^n$ subframe method (weighting) is a method of separately controlling turning on/off eight subframes having drive times in the ratio of 1:2:4: . . . 128 based on the input value, thereby representing 256 gradation levels. A method of executing ΔΣ modulation in response to the input value for each pixel, controlling turning on/off based on the output, and controlling gradation based on the pulse density is also available.

However, in the pulse modulation, the former method has the disadvantage that if the weight ratio goes wide of the target, a rapid brightness level difference occurs in the high-order bit carry. For a moving image, a strong pseudo contour phenomenon still occurs in the high-order bit carry.

On the other hand, the latter method has the disadvantage that unless the oversampling ratio, namely, the number of subframes is raised to some extent or more, the on period per pixel at the low brightness time becomes drastically lower than the frame frequency, causing flicker to appear, degrading the display image quality.

SUMMARY OF THE INVENTION

The invention has been made to solve the above problems with the related art, and therefore an object of the invention is to provide a light emission display drive method and drive apparatus wherein a driver capable of performing output control of three or more levels in the output brightness value of each light emission element is provided and when the intermediate level of the three or more output brightness levels is represented, a ΔΣ modulator controls the distribution of the occurrence probability of each level, whereby the number of gradation levels that can be represented is increased for improving representation pixels.

To achieve the above object, according to a first aspect of the invention, there is provided a light emission display drive method for use with a control signal generation circuit of a light emission display having a driver comprising a ΔΣ modulator and being capable of performing control at three or more levels in an output brightness value of a light emission element, characterized in that an intermediate level of three or more output brightness levels of the light emission element is represented by controlling the distribution of the occurrence probability of each of the levels by the ΔΣ modulator.

According to a second aspect of the invention, there is provided a light emission display drive apparatus having a driver being capable of performing control at three or more levels in an output brightness value of a light emission element, the light emission display drive apparatus comprising a read section for reading the brightness value of the light emission element to be represented in a predetermined period and a ΔΣ modulation signal processing section for converting the numeric value read by the read section into distribution of the occurrence probability at each level of the output brightness value at the three or more levels.

According to a third aspect of the invention, in the light emission display drive apparatus of the second aspect of the invention, the ΔΣ modulation signal processing section comprises one channel of at least first-order ΔΣ modulator containing a quantizer having a determination level in the middle of three or more output brightness levels of the light emission element, quantizing the numeric value based on each determination level, and outputting output values corresponding to brightness values at the three or more levels, and a unit being responsive to output of the ΔΣ modulator for selecting the brightness values at the three or more levels of the driver.

According to a fourth aspect of the invention, in the light emission display drive apparatus of the second aspect of the invention, the ΔΣ modulation signal processing section comprises a plurality of separate at least first-order ΔΣ modulators and a distributor for distributing the brightness values to be represented, read by the read section to inputs of the separate ΔΣ modulators.

According to the described configuration, to begin with, gradation representation of three or more levels can be accomplished in the output brightness value of each light emission element and the ΔΣ modulator controls the distribution of the occurrence probability at each of the three or more levels, whereby halftone gradation representation of three to 16 levels is made possible and 256-level gradation required for representing a video signal can be easily represented.

As compared with the case where multiple-level gradation representation is conducted using ΔΣ modulation as the control of the occurrence probability in output of pulse modulation, namely, two levels of on and off, the intermediate values that can be represented are further more subdivided, so that the number of gradation levels is increased dramatically and the oversampling ratio, namely, the display frame frequency can be set lower, so that multiple-level gradation representation is made possible even with a display drive device at low operation speed, such as TFT.

Further, at the low gradation time, gradation is represented by turning on and off low output brightness values only. Thus, as compared with the case where gradation is represented by controlling output of two levels of on and off, the number of on times can be increased relatively and flicker is decreased as a result.

BRIEF DESCRIPTION OF THE DRAWINGS

In the accompanying drawings:

FIGS. 3A and 3B are drawings cited to describe the operation of the embodiment of the invention shown in FIGS. 2A and 2B, in which FIG. 3A is a drawing to show outputs of actual drive channel and FIG. 3B is a drawing to show drive output values in actual organic EL element provided by combining the outputs;

FIG. 4 is a drawing cited to describe the operation of the embodiment of the invention shown in FIGS. 2A and 2B; it is a table to show a numeric value setting example for the ΔΣ modulation signal processing section;

FIGS. 8A and 8B are drawings cited to describe the operation of the embodiment of the invention shown in FIGS. 7A and 7B, in which FIG. 8A is a drawing to show outputs of actual drive channel and FIG. 8B is a drawing to show drive output values in actual organic EL element provided by combining the outputs;

FIG. 9 is a drawing cited to describe the operation of the embodiment of the invention shown in FIGS. 7A and 7B; it is a table to show a numeric value setting example for the ΔΣ modulation signal processing section;

DETAILED DESCRIPTION OF THE PREFERRED EMBODIMENTS

Prior to the description of embodiments of the invention, an example of the driver capable of performing control of three or more levels in the output brightness value of each light emission element described above will be discussed using a method of providing four, eight, 16 levels of output brightness value by a two-bit to four-bit weight drive method by controlling turning on and off two to four weight current sources. It is assumed that as weight examples of two-bit to four-bit outputs, (1) for two bits, two drive sources at weight ratio a1:1 (where a1>1);

(2) for three bits, three drive sources at weight ratio a2:a1:1 (where a2>a1+1, a1>1);

(3) for four bits, four drive sources at weight ratio a3:a2:a1:1 (where a3>a2+a1+1, a2>a1+1, a1>1); and the like are provided, and they can be combined as desired for output.

It is common practice to set the weight ratio to a3:a2:a1:1=8:4:2:1, but the weight ratio is not limited to it and the fact that if any other ratio is used, the invention is not hindered will be discussed with the case where a1:1=4:1 as illustrated below. In the above-given examples, the number of drive output levels is four (for two bits), eight (for three bits) or 16 (for four bits), but if the number of drive output levels is not four, eight, or 16, the effectiveness of the invention is not impaired.

Figure 12A:
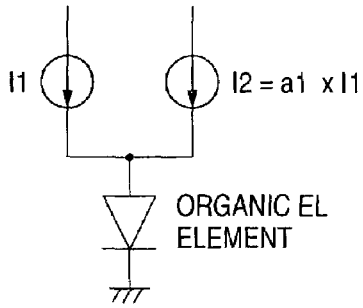
FIGS. 12A and 12B are drawings cited to describe a drive method of a light emission display in binary mode.
Figure 12B:
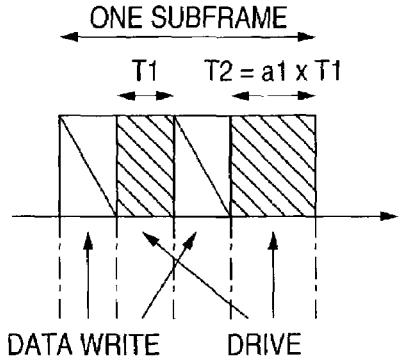

Specifically, in binary mode, two weight current sources as shown in FIG. 12A, a constant-current drive with one frame divided into two subframes as shown in FIG. 12B, or the like can be taken as an example. How such multi-value output is accomplished in a ΔΣ modulation signal processing section 3 is the subject matter of the invention.

Figure 1:
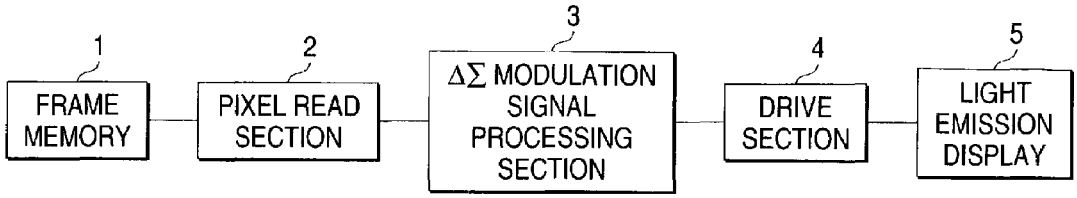
FIG. 1 is a block diagram to show one embodiment of a light emission display drive apparatus in the invention.

The configurations and operation of embodiments of the invention will be discussed in detail. FIG. 1 is a block diagram to show one embodiment of a light emission display drive apparatus in the invention.

The light emission display drive circuit of the invention is made up of frame memory 1, a read section 2, a ΔΣ modulation signal processing section 3, a drive section 4, and a light emission display 5.

The read section 2 reads pixel data from the frame memory 1 in synchronization with a subframe pulse $f_{SF}$ ($=nf_F$) repeatedly output in a subframe period provided by dividing a frame period by n and outputs the pixel data to the ΔΣ modulation signal processing section 3. The drive section 4 turns on/off a drive current in response to output of the ΔΣ modulation signal processing section 3 and supplies the drive current to the light emission display 5 for providing any desired multiple-level gradation display.

The following two embodiments of the ΔΣ modulation signal processing section 3 are possible: One is an embodiment wherein one channel of ΔΣ modulator is provided, a special configuration of three-value threshold four-value output is provided as a quantizer, and the four output values are encoded by two bits for controlling binary output channel separately. The other is an embodiment wherein separate ΔΣ modulators are provided in a one-to-one correspondence with weight outputs and a distributor is provided for distributing numeric values to represent gradation in input.

Figure 2A:
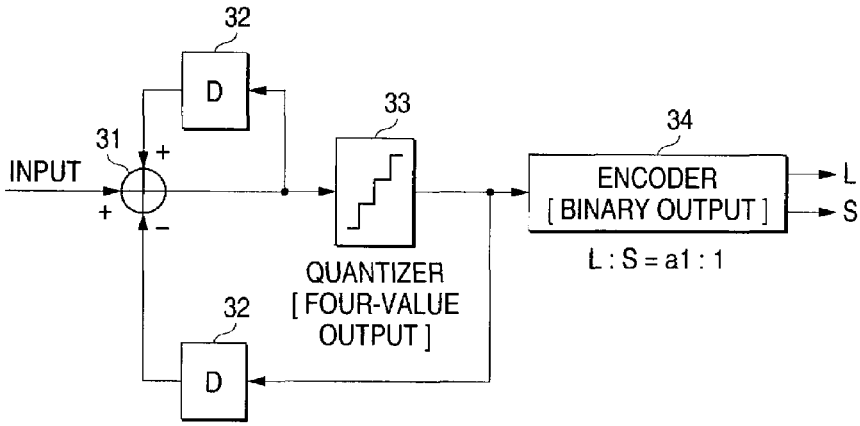
FIGS. 2A and 2B are block diagrams to show one embodiment of a ΔΣ modulation signal processing section in FIG. 1.
Figure 2B:
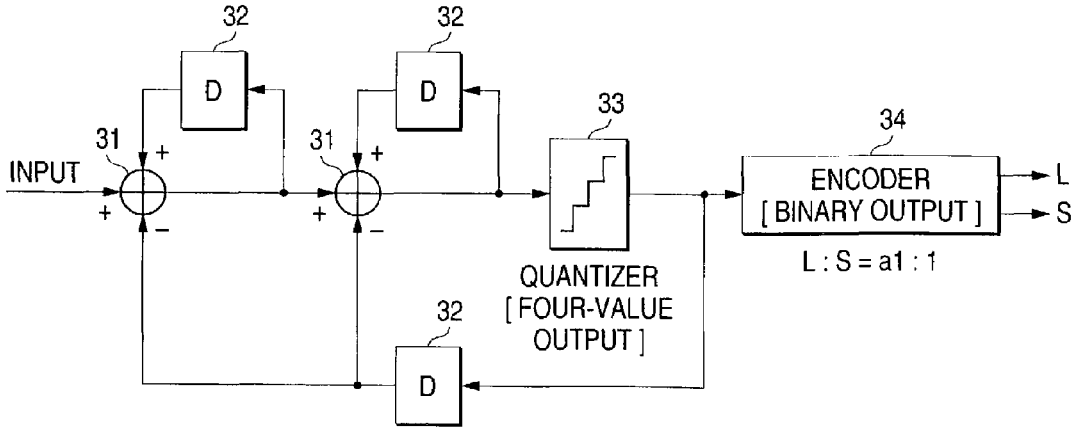

FIGS. 2A and 2B are block diagrams to show one embodiment of the ΔΣ modulation signal processing section 3 in FIG. 1 (the former embodiment described above); FIG. 2A shows the configuration of the ΔΣ modulation signal processing section 3 using a first-order ΔΣ modulator and FIG. 2B shows the configuration of the ΔΣ modulation signal processing section 3 using a second-order ΔΣ modulator.

Each of the first-order and second-order ΔΣ modulators consisting of an integration section consisting of an adder 31 and delay circuits 32 and a quantizer 33, as well known. The ΔΣ modulation signal processing section 3 compares the output of the integration section with three threshold values by the quantizer 33 to produce four-value output and converts the output into a binary value "L" or "S" through an encoder 34 for output.

Weights are assigned to the binary outputs "L" and "S" and here the weight ratio L:S=a1:1.

FIGS. 3A and 3B are drawings cited to describe the operation of one embodiment of the invention shown in FIGS. 2A and 2B; FIG. 3A shows outputs of actual drive channel (weight 1 output and weight a1 output) and FIG. 3B shows drive output values in actual organic EL element provided by combining the outputs.

Specifically, when weight 1 output and weight a1 output are both OFF, 0 is provided; when weight 1 output is ON and weight a1 output is OFF, 1 is provided; when weight 1 output is OFF and weight a1 output is ON, a1 is provided; when weight 1 output and weight a1 output are both ON, 1+a1 is provided. The output values of the quantizer 33 are set corresponding to the combined values.

FIG. 4 shows a numeric value setting example of the ΔΣ modulation signal processing section 3. That is, assuming that the weight ratio of two outputs is 1:a1 (where a1>1), if the input range is x1 to x2 (eight-bit 256 gradation levels), the input to the ΔΣ modulation signal processing section 3 is a numeric value in steps of 1.0 in the range of "−127.5 to +127.5." Here, the center is 0.0 and the width is 255. Usually, an input signal is 0 to 255 and thus it is suggested that the numeric value is offset −127.5 for use.

Here, assuming that the four output values of the quantizer 33 are y1, y2, y3, and y4, [y1, y4]=[x1−α, x2+α] as peak-to-peak value where α is set to a sufficiently small value and setting is made a little wider than the input value. As intermediate values, y2 and y3 are set so that (y4−y1):(y3−y1):(y2−y1)=(a1+1):a1:1.

Figures 5, 6A, 6B:
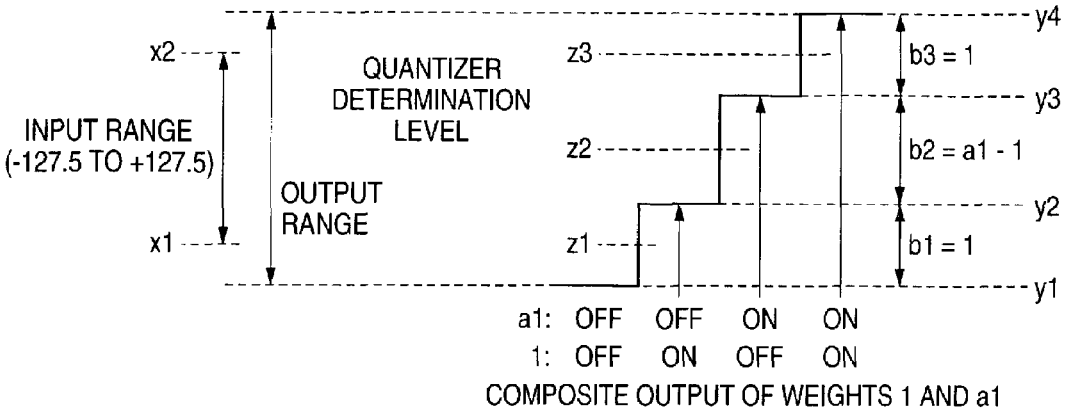
FIG. 5 is a drawing cited to describe a specific example of setting numeric values in accordance with the table shown in FIG. 4.
FIGS. 6A and 6B are tables cited to describe the operation of the embodiment of the invention; the tables list numeric value examples of parts relative to actual weight amounts.

Next, assuming that three levels of threshold value of the quantizer 33 are z1, z2, and z3, z1=(y1+y2)/2, z2=(y2+y3)/2, and z3=(y3+y4)/2, each being the middle point of each level difference FIG. 5 shows a specific example of numeric value setting. The numeric values are set in accordance with the table shown in FIG. 4 for the input value range, the quantizer 33 output value range, and the quantizer 33 determination level in the arithmetic processing channel of the ΔΣ modulation signal processing section 3.

Specifically, when the input value is y1<x<y2, the weight 1 output travels between OFF and ON with the weight a1 output remaining OFF. Here, as x rises, the weight 1 output increases in the frequency of ON. When y2<x<y3, the combination of [weight 1 output, weight a1 output] travels between [ON, OFF] and [OFF, ON]. Here, as x rises, the frequency of [1:OFF, a1:ON] increases.

Further, when the input value is y3<x<y4, the weight 1 output travels between OFF and ON with the weight a1 output remaining ON. Here, as x rises, the weight 1 output increases in the frequency of ON.

The above-described operation is performed, whereby the output y is an approximate value to the input x in terms of time average as a result. So long as a1>1, whenever x rises, y also rises and thus if the input eight-bit numeric value comes near to carry, discontinuity does not occur.

Specific numeric value examples of parts relative actual weight amounts are listed in tables of FIGS. 6A and 6B. The table shown in FIG. 6A shows an example wherein weight output a1 is set to 2 and the table shown in FIG. 6B shows an example wherein weight output a1 is set to 4.

In the table in FIG. 6A, assuming that b1:b2:b3 shown in FIG. 5 is set to 1:1:1, if the peak-to-peak value is, for example, [y1, y4]=[−130.5, +130.5] with respect to outputs y1, y2, y3, and y4, others are divided by 3, resulting in [y2, y3]=[−43.5, +43.5]. In conclusion, [y1, y2, y3, y4]=[−130.5, −43.5, +43.5, +130.5]. At this time, quantizer S determination level [z1, z2, z3]=−87.0, 0.0, +87.0.

In the table in FIG. 6B, assuming that b1:b2:b3 shown in FIG. 5 is set to 1:3:1, if the peak-to-peak value is, for example, [y1, y4]=[−132.5, +132.5] with respect to outputs y1, y2, y3, and y4, others are multiplied by ⅗, resulting in [y2, y3]=[−79.5, +79.5]. In conclusion, [y1, y2, y3, y4]=[−132.5, −79.5, +79.5, +132.5]. At this time, quantizer S determination level [z1, z2, z3]=−106.0, 0.0, +106.0.

Figure 7A:
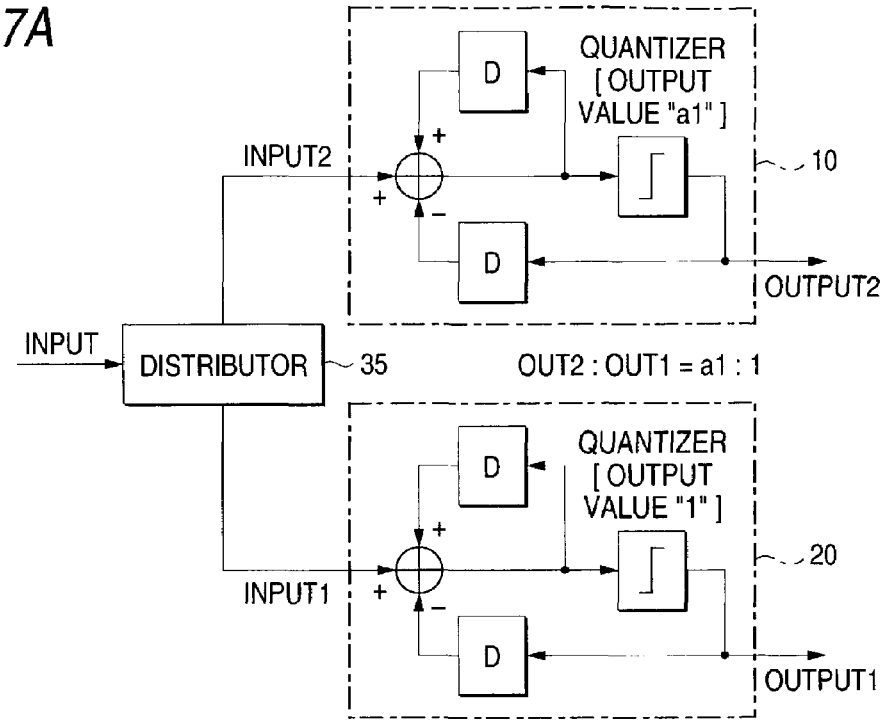
FIGS. 7A and 7B are block diagrams to show another embodiment of the ΔΣ modulation signal processing section in FIG. 1.
Figure 7B:
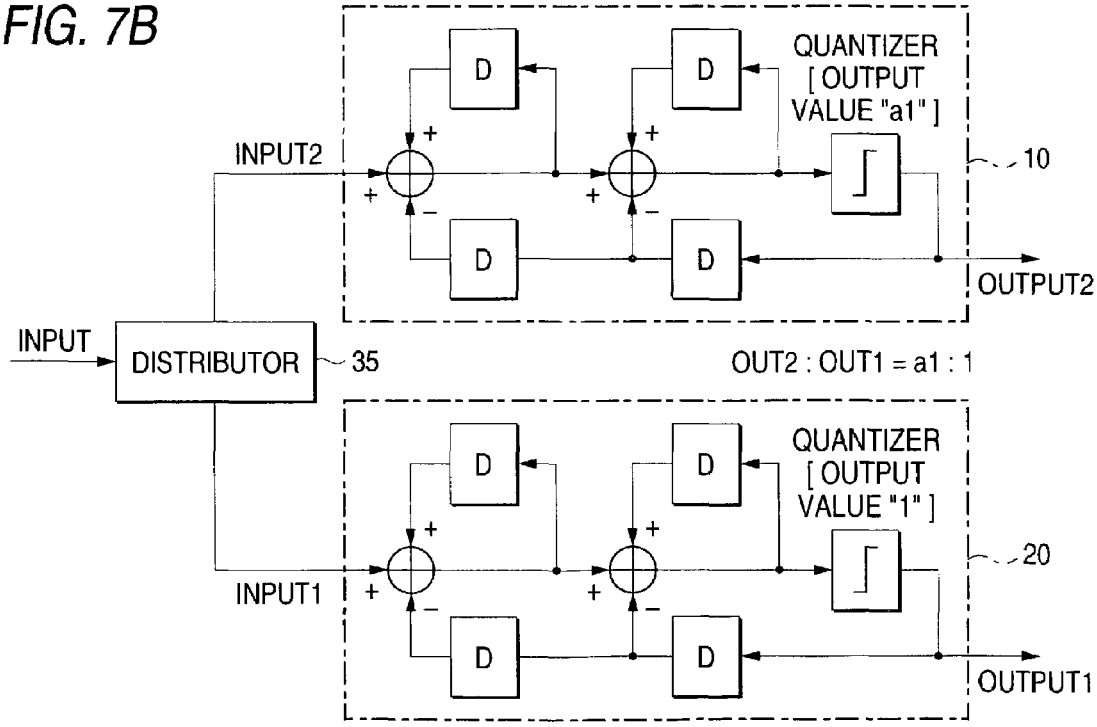

FIGS. 7A and 7B are block diagrams to show another embodiment of the ΔΣ modulation signal processing section 3 in FIG. 1 (the latter embodiment described above); FIG. 7A shows the configuration of the ΔΣ modulation signal processing section 3 using first-order ΔΣ modulators and FIG. 7B shows the configuration of the ΔΣ modulation signal processing section 3 using second-order ΔΣ modulators.

Separate ΔΣ modulators 10 and 20 are provided for weight outputs Output1 and Output2 respectively and a distributor 35 is added for distributing the numeric values to represent gradation in input for supplying Input1 and Input2 to the ΔΣ modulators 10 and 20 respectively.

FIGS. 8A and 8B are drawings cited to describe the operation of the embodiment of the invention shown in FIGS. 7A and 7B; FIG. 8A shows outputs of actual drive channel (weight 1 output and weight a1 output) and FIG. 8B shows drive output values in actual organic EL element provided by combining the outputs.

Specifically, when weight 1 output and weight a1 output are both OFF, 0 is provided; when weight 1 output is ON and weight a1 output is OFF, 1 is provided; when weight 1 output is OFF and weight a1 output is ON, a1 is provided; when weight 1 output and weight a1 output are both ON, 1+a1 is provided. The output values of the quantizers 33 are set so that the ratio becomes 1:a1.

FIG. 9 shows a numeric value setting example of the ΔΣ modulation signal processing section 3. That is, assuming that the weight ratio of two outputs is 1:a1(where a1>1), if the input range is x1 to x2 (eight-bit 256 gradation level), the input to the ΔΣ modulation signal processing section 3 is a numeric value in steps of 1.0 in the range of "−127.5 to +127.5." Here, the center is 0.0 and the width is 255.

As the reference values to set two values of weight 1 quantizer 33 output, p1 and p2, and two values of weight a1 quantizer 33 output, q1 and q2, described later, according to the table shown in FIG. 4, assuming that the four output values of the quantizer 33 are y1, y2, y3, and y4, [y1, y4]=[x1−α, x2+α] as peak-to-peak value, and as intermediate values, y2 and y3 are set so that (y4−y1):(y3−y1):(y2−y1)=(a1+1) :a1:1.

Figure 10A:
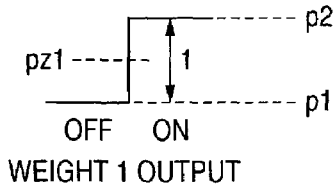
FIGS. 10A and 10B are drawings cited to describe the operation of the embodiment of the invention shown in FIGS. 7A and 7B and are drawings to show specific numeric value setting examples for quantizers.
Figure 10B:
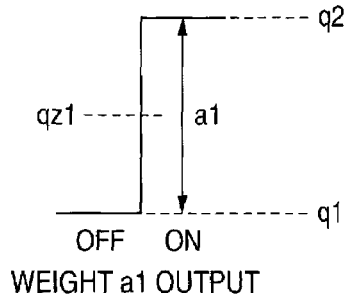

FIGS. 10A and 10B show examples of setting numeric values of the quantizers 33 according to the table shown in FIG. 9. The two values of weight 1 quantizer 33 output, p1 and p2, are as follows: p1=−(y2−y1)/2, p2 =+(y2−y1)/2, and threshold level pz1=0.0. The threshold level pz1 is the center value of p1 and p2. The two values of weight a1 quantizer 33 output, q1 and q2, are as follows: q1=−(y3−y1)/2, q2=+(y3−y1)/2, and threshold level qz1=0.0. The threshold level qz1 is the center value of q1 and q2.

Figure 11A:
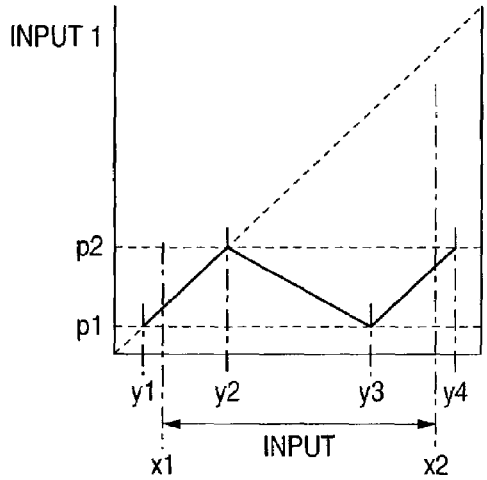
FIGS. 11A and 11B are drawings cited to describe the operation of the embodiment of the invention shown in FIGS. 7A and 7B and are drawings to show the distributor operation only in graph form.
Figure 11B:
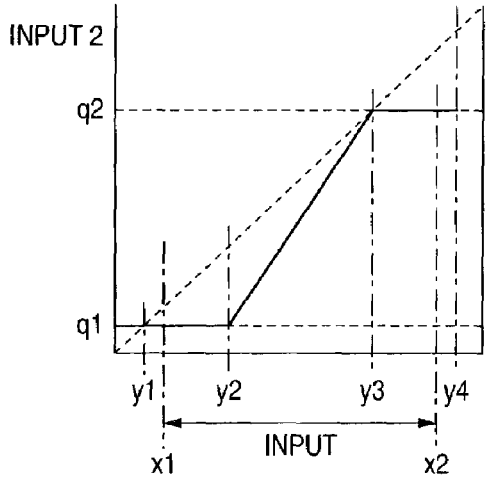

The operation of the distributor 35 is shown in FIGS. 11A and 11B in graph form. FIGS. 11A and 11B are graphs to show the relationship between input and output of the distributor 35. In FIG. 11A, input to the ΔΣ modulator 10 (Input1) is plotted on the vertical axis and outputs y1 to y4 are plotted on the horizontal axis; In FIG. 11B, input to the ΔΣ modulator 20 (Input2) is plotted on the vertical axis and outputs y1 to y4 are plotted on the horizontal axis. Here, Input=Input1+Input2.

As described above, in the invention, to overcome the disadvantage of pulse modulation using the ΔΣ modulators, the driver capable of performing multi-level control of three or more levels is provided and the control is performed by ΔΣ modulation, whereby the intermediate level between the levels is replaced with distribution of the occurrence probability of the levels on both sides of the intermediate level. The control of distribution of the occurrence probability is the ΔΣ modulation action itself and thus can be easily realized.

The control is thus performed, whereby as compared with the case where multiple-level gradation representation is conducted using ΔΣ modulation as the control of the occurrence probability in output of pulse modulation, namely, two levels of on and off, the intermediate values that can be represented are furthermore subdivided, so that the number of gradation levels is increased dramatically and the oversampling ratio, namely, the display frame frequency can be set lower, so that multiple-level gradation representation is made possible even with a display drive device at low operation speed, such as TFT.

In low gradation, etc., gradation is represented by turning on and off low output brightness values only. Thus, as compared with the case where gradation is represented by controlling output of two levels of on and off, the number of on times can be increased relatively, so that flicker can be decreased as a result.

As compared with the weight subframe method in the related art, eight weight outputs are required to produce 256-level gradation display in the related art, but even two weight outputs make it possible to provide sufficient effect the configuration can be simplified. Basically, gradation is represented by ΔΣ modulation processing and thus excellent gradation linearity is provided. If variations in weight amount occur and the actual weight ratio goes wide of the target, the weight ratio itself maybe far smaller (as compared with 1:128), so that the adverse effect is small and concatenation becomes only a diode function and no discontinuity occurs, so that no problem arises.

Further, according to the invention, any desired weight ratio can be set and if the weight ratio deviates from the planned ratio in the drive section, the numeric value of the quantizer in the ΔΣ modulator may be changed. This means that the later correction can be made by changing the algorithm. To set a numeric value of the quantizer, a different value is intentionally set with respect to the real weight ratio in the drive section, whereby the relationship between the input value and the output brightness can also be deviated from a linear relationship and so-called γ correction characteristic can also be provided.

As described above, in the invention, the driver capable of performing multi-level control of three or more levels is provided for driving light emission elements and the control is performed by ΔΣ modulation, whereby the intermediate level between the levels is replaced with distribution of the occurrence probability of the levels on both sides of the intermediate level, thereby representing gradation, so that it is made possible to improve the display image quality.

That is, the intermediate values that can be represented are furthermore subdivided, so that the number of gradation levels is increased dramatically and the oversampling ratio, namely, the display frame frequency can be set lower, so that multiple-level gradation representation is made possible even with a display drive device at low operation speed, such as TFT.

At the low gradation time, gradation is represented by turning on and off low output brightness values only. Thus, as compared with the case where gradation is represented by controlling output of two levels of on and off, the number of on times can be increased relatively and it is made possible to decrease flicker as a result.

What is claimed is:

1. A light emission display drive method for use with a control signal generation circuit of a light emission display having a driver comprising a ΔΣ modulator and being capable of performing control at three or more levels in an output brightness value of a light emission element, said method comprising the steps of:

representing an intermediate level of three or more output brightness levels of the light emission element by controlling distribution of occurrence probability of each of the levels by the ΔΣ modulator.

2. A light emission display drive apparatus having a driver being capable of performing control at three or more levels in an output brightness value of a light emission element, said apparatus comprising:

a read section for reading the brightness value of the light emission element to be represented in a predetermined period; and a ΔΣ modulation signal processing section for converting the numeric value read by said read section into distribution of occurrence probability at each level of the output brightness value at the three or more levels.

3. The light emission display drive apparatus as claimed in claim 2 wherein said ΔΣ modulation signal processing section comprises:

one channel of at least first-order ΔΣ modulator containing a quantizer having a determination level in the middle of three or more output brightness levels of the light emission element, quantizing the numeric value based on each determination level, and outputting output values corresponding to brightness values at the three or more levels; and a unit being responsive to output of the ΔΣ modulator for selecting the brightness values at the three or more levels of the driver.

4. The light emission display drive apparatus as claimed in claim 2 wherein said ΔΣ modulation signal processing section comprises:

a plurality of separate at least first-order ΔΣ modulators; and a distributor for distributing the brightness values to be represented, read by said read section to inputs of the separate ΔΣ modulators.

* * * * *